US006775853B1

(12) United States Patent
Szekely

(10) Patent No.: US 6,775,853 B1
(45) Date of Patent: Aug. 17, 2004

(54) VENTILATED TOILET ASSEMBLY

(76) Inventor: Attila Szekely, 708 Concession St, Apt 1, Hamilton, Ontario (CA), L8V 1C1

( * ) Notice: Subject to any disclaimer, the term of this patent is extended or adjusted under 35 U.S.C. 154(b) by 0 days.

(21) Appl. No.: 10/619,117

(22) Filed: Jul. 15, 2003

(51) Int. Cl.[7] ..... A47K 13/00; E03D 9/04
(52) U.S. Cl. ..... 4/217; 4/213
(58) Field of Search ..... 4/209 R, 213, 4/216, 217, 218

(56) References Cited

U.S. PATENT DOCUMENTS 4,494,255 A * 1/1985 Drummond ..... 4/213
D350,187 S 8/1994 Landes
5,353,443 A 10/1994 Sim
5,454,122 A 10/1995 Bergeron
5,724,682 A 3/1998 Johnson
5,875,496 A * 3/1999 Schaffer ..... 4/213
5,898,951 A 5/1999 Rakoz
6,163,893 A 12/2000 Lo
6,237,163 B1 5/2001 Guzzo et al.

* cited by examiner

*Primary Examiner*—Tuan N. Nguyen

(57) ABSTRACT

A ventilated toilet assembly includes a ventilated toilet seat device for positioning between a toilet bowl and a water tank. The device comprises a base section having an aperture extending therethrough. The base section is positioned between the toilet bowl and the water tank. An exhaust conduit extends through the base section. An air moving assembly is mounted in the exhaust conduit for selectively drawing air into an exhaust inlet and forcing the air outwardly through an exhaust outlet. A toilet seat is hingedly attached to the base section. A tubular member is mounted on a bottom side of the toilet. The tubular member forms a loop and has a coupler fluidly coupled thereto. The coupler is aligned with and is fluidly coupled to the exhaust inlet when the toilet seat is abutted against the toilet bowl. The tubular member has a plurality of apertures extending therein.

9 Claims, 5 Drawing Sheets

12
13
48
49
61
30
33
14
15
11

VENTILATED TOILET ASSEMBLY

BACKGROUND OF THE INVENTION

1. Field of the Invention

The present invention relates to ventilated toilet devices and more particularly pertains to a new ventilated toilet device for venting air from a toilet bowl.

2. Description of the Prior Art

The use of ventilated toilet devices is known in the prior art. Generally, these types of devices are either constructed as an integral part of a toilet or are an add-on device of tubing which is usually positioned in or around a toilet bowl area. While these devices fulfill their respective, particular objectives and requirements, the need remains for a device that is integral to a toilet seat, but is still retrofittable to existing toilets.

SUMMARY OF THE INVENTION

The present invention meets the needs presented above by incorporating a base section, having an air exhaust conduit therein, which is positionable between the water tank and the toilet bowl to give the base section additional stability for the supporting of a toilet seat. Additionally, by placing the base section beneath the water tank and on top of the toilet bowl, the assembly takes up less room than previous designs.

Another object of the present invention is to provide a new ventilated toilet device that includes a tubular member having a holes therein which is mounted on the toilet seat for drawing air outward of the toilet bowl.

Still another object of the present invention is to provide a new ventilated toilet device that includes automatic actuators, such as pressure sensitive switches or motion detectors, to activate the air moving assembly within the present device to draw air outward of the toilet bowl.

To this end, the present invention generally comprises a ventilated toilet seat device for positioning between a toilet bowl and a water tank of the toilet bowl. The water tank includes a water outlet and the toilet bowl includes a water inlet. The device comprises a base section having an upper surface, a bottom surface, a front side, a rear side, a first lateral side and a second lateral side. An aperture extends through the upper and bottom surfaces. The base section is positioned between the toilet bowl and the water tank such that the aperture is aligned with the water outlet and the water inlet. The front side generally faces a bowl portion of the toilet bowl. An exhaust conduit extends through the base section and includes an exhaust inlet and an exhaust outlet. The exhaust inlet is positioned in the front side. An air moving assembly is mounted in the exhaust conduit for selectively drawing air into the exhaust inlet and forcing the air outwardly through the exhaust outlet. A toilet seat is hingedly attached to the front side of the base section. The toilet seat has a top side, a bottom side, a forward end and a rearward end. The rearward end is positioned adjacent to the to the front side. The toilet seat has an outer edge and an inner edge. The inner edge defines an opening extending through the toilet seat. A tubular member is mounted on the bottom side of the toilet. The tubular member forms a loop and has a coupler fluidly coupled thereto. The coupler is positioned adjacent to the rearward end and is aligned with and fluidly coupled to the exhaust inlet when the toilet seat is abutted against the toilet bowl. The tubular member has a plurality of apertures extending therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic perspective view of the present invention.

DESCRIPTION OF THE PREFERRED EMBODIMENT

Figure 1:
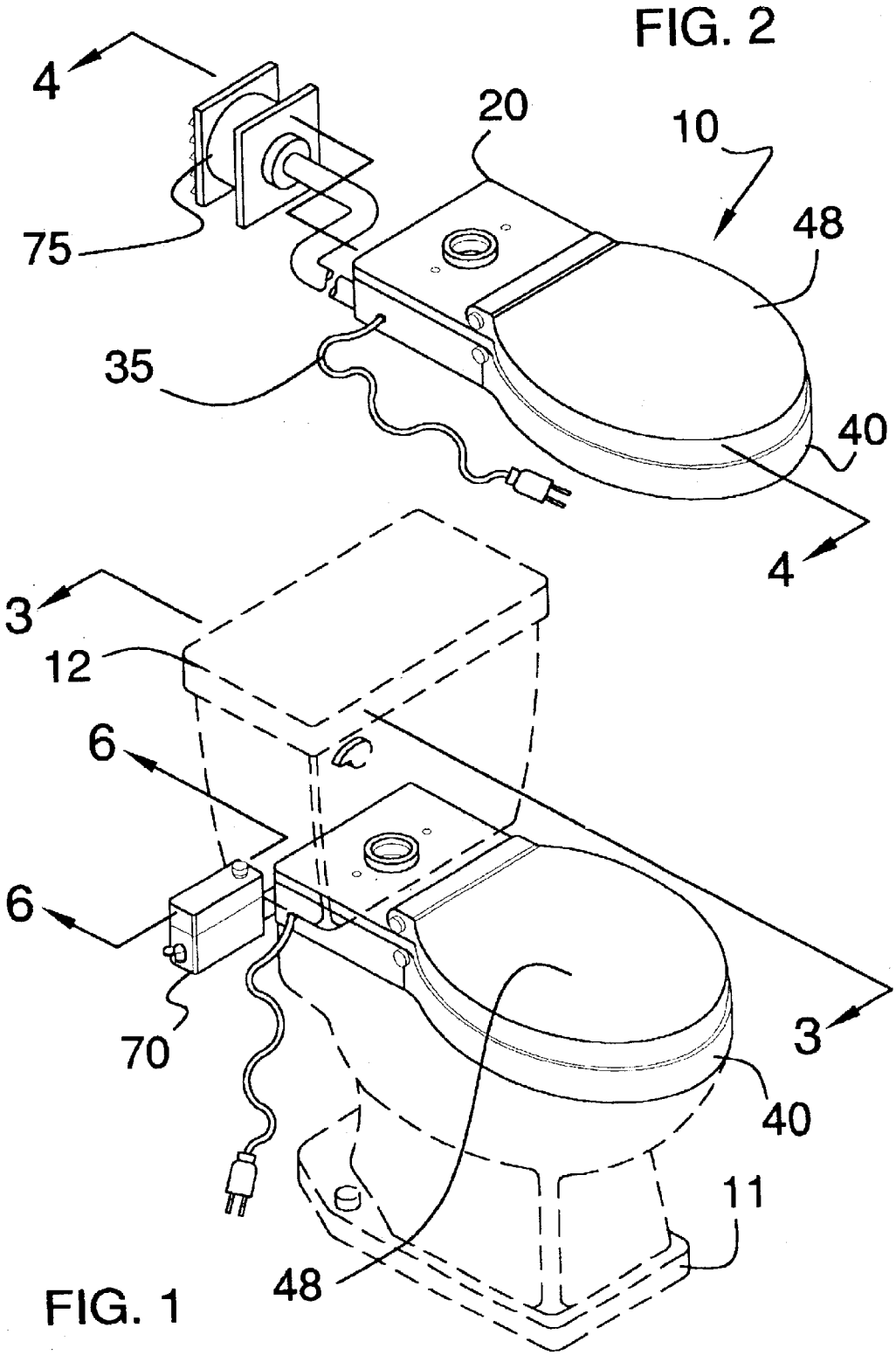
FIG. 1 is a schematic perspective view of a ventilated toilet assembly according to the present invention.
Figure 3:
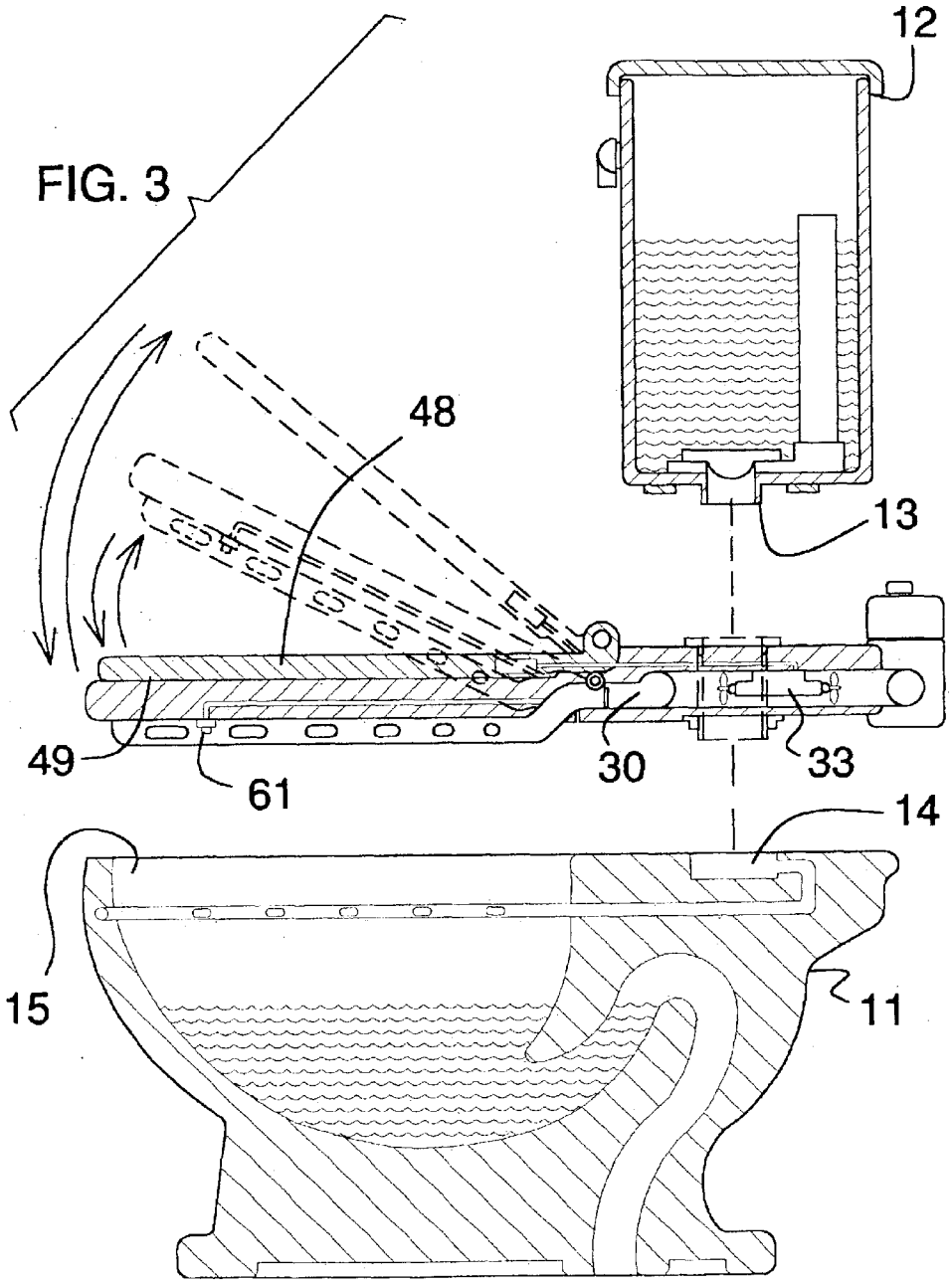
FIG. 3 is a schematic cross-sectional view taken along line 3—3 of FIG. 1 of the present invention.
Figure 5:
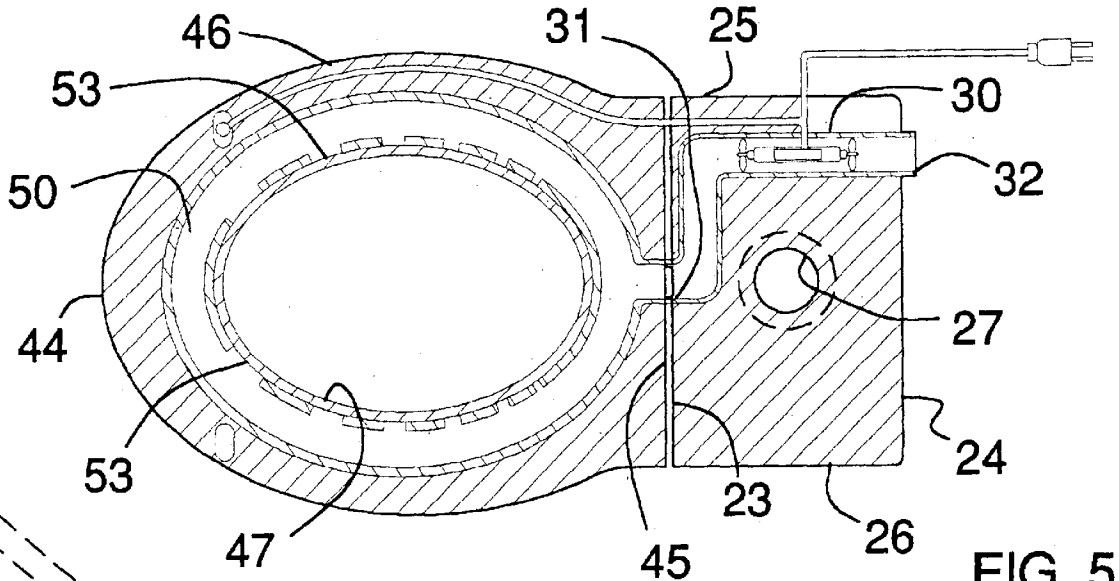
FIG. 5 is a schematic cross-sectional view taken along line 5—5 of FIG. 4 of the present invention.
Figure 4:
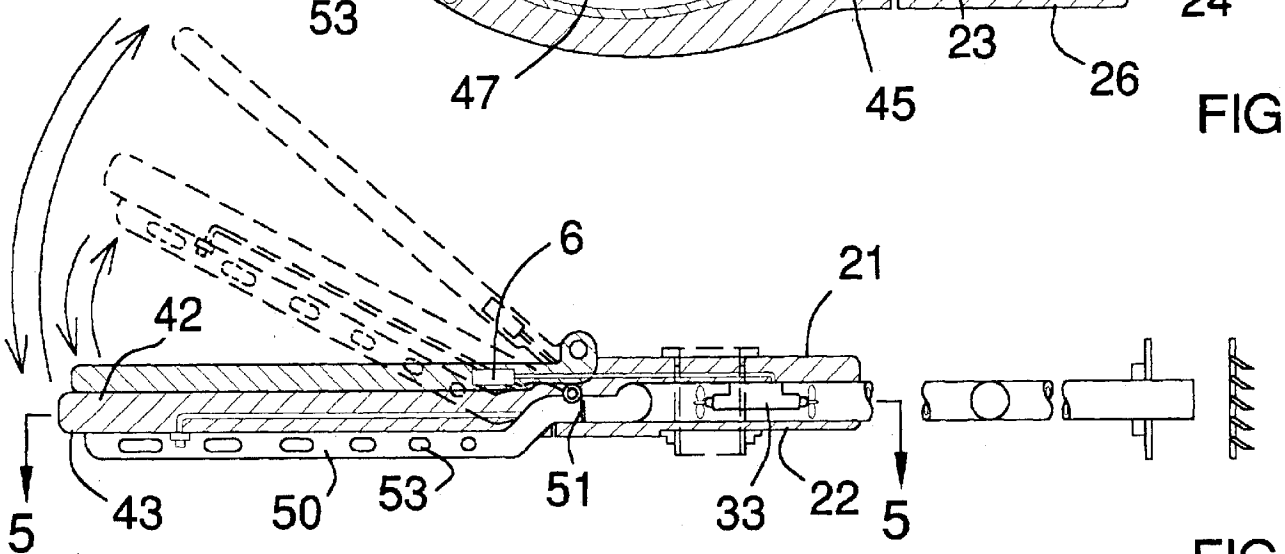
FIG. 4 is a schematic cross-sectional view taken along line 4—4 of FIG. 3 of the present invention.
Figure 6:
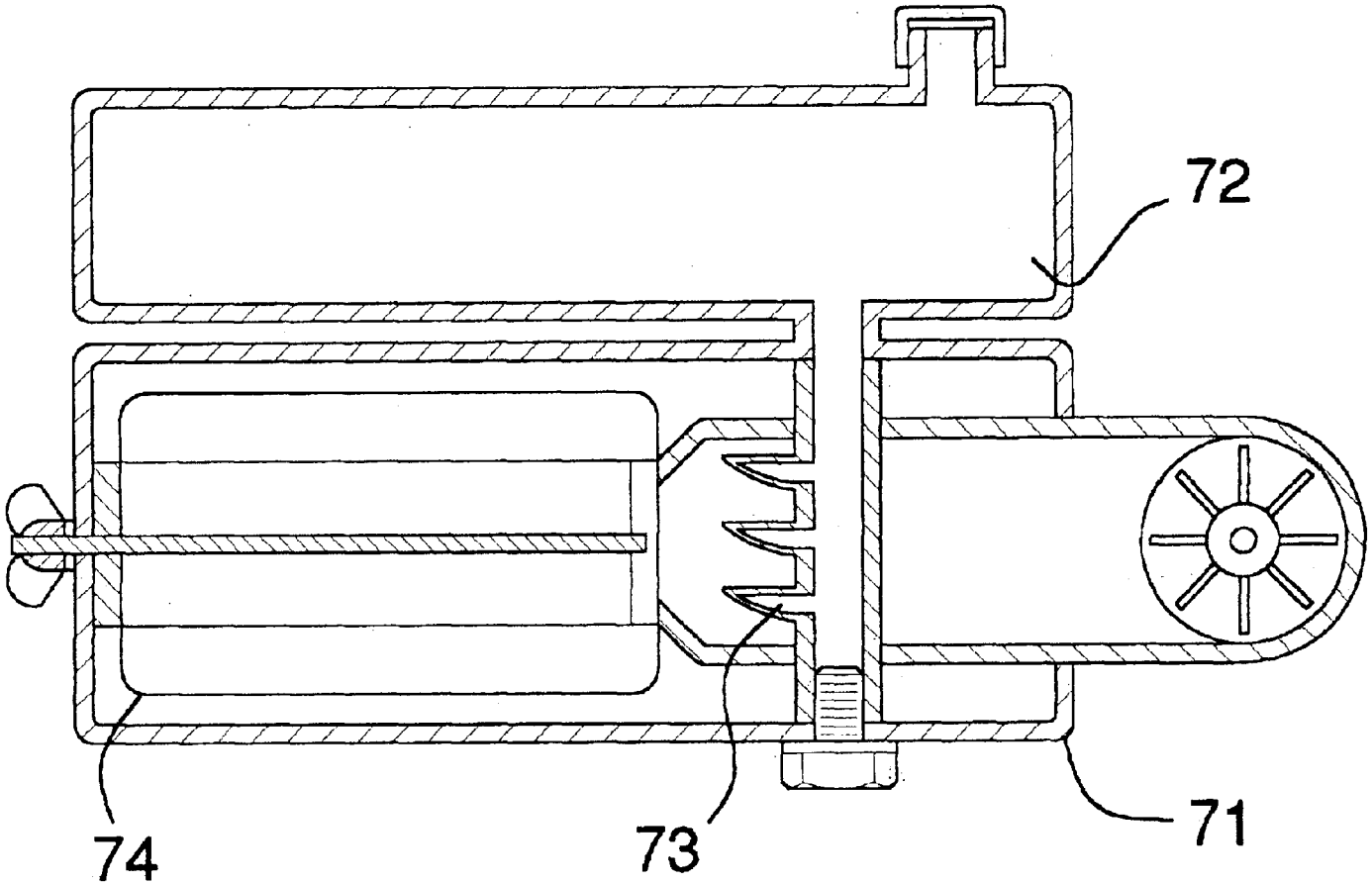
FIG. 6 is a schematic cross-sectional view taken along line 6—6 of FIG. 1 of the present invention.
Figure 7:
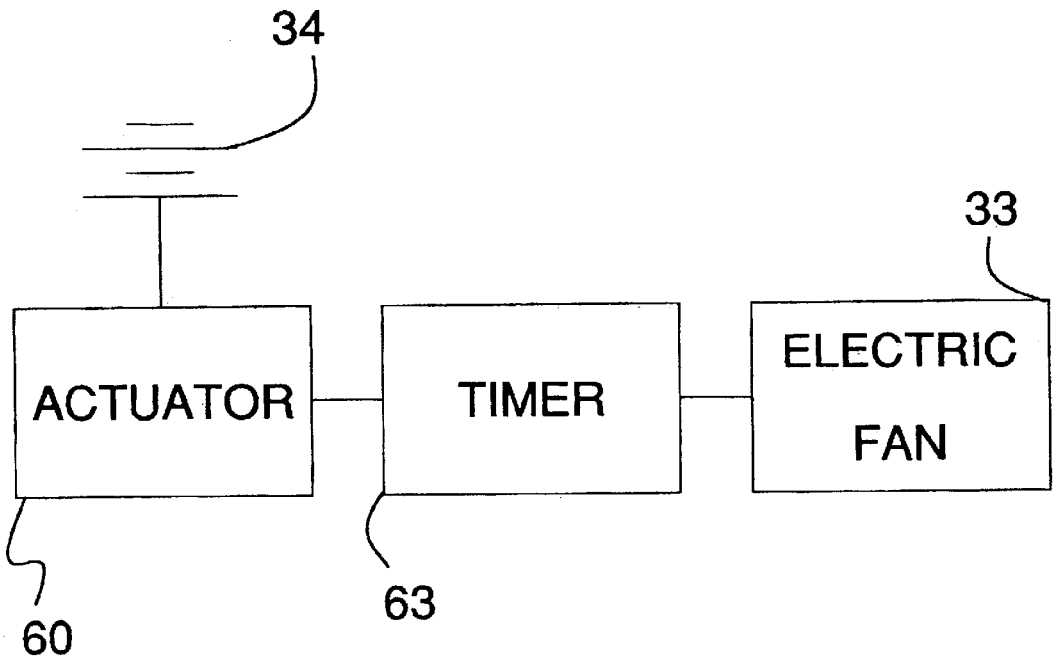
FIG. 7 is an electronic schematic view of the present invention.

With reference now to the drawings, and in particular to FIGS. 1 through 7 thereof, a new ventilated toilet device embodying the principles and concepts of the present invention and generally designated by the reference numeral 10 will be described.

As best illustrated in FIGS. 1 through 7, the ventilated toilet assembly 10 generally comprises a device for positioning between a toilet bowl 11 and a water tank 12 of the toilet bowl 1. The water tank 12 includes a water outlet 13. The toilet bowl 11 includes a water inlet 14. The assembly 10, or device, includes a base section 20 having an upper surface 21, a bottom surface 22, a front side 23, a rear side 24, a first lateral side 25 and a second lateral side 26. An aperture 27 extends through the upper 21 and bottom 22 surfaces. The base section 20 is positioned between the toilet bowl 11 and the water tank 12 such that the aperture 27 is aligned with the water outlet 13 and the water inlet 14. The front side 23 generally faces a bowl portion 15 of the toilet bowl 11.

An exhaust conduit 30 extends through the base section 20 and includes an exhaust inlet 31 and an exhaust outlet 32. The exhaust inlet 31 is positioned in the front side 23. An air moving assembly 33 is mounted in the exhaust conduit 30 for selectively drawing air into the exhaust inlet 31 and forcing the air outwardly through the exhaust outlet 32. The air moving assembly 33 preferably comprises one or more electric fans. A power supply 34 is electrically coupled to the air moving assembly 33 and may include a power plug 35 or the air moving assembly 33 may be hardwired directly into an electrical system of the dwelling in which the toilet bowl 11 is placed.

A toilet seat 40 is hingedly attached to the front side 23 of the base section 20. The toilet seat 40 has a top side 42, a bottom side 43, a forward end 44 and a rearward end 45. The toilet seat 40 is shown in cross-section along its length in FIGS. 3 and 4 for reasons which will become obvious below. The rearward end 45 is positioned adjacent to the to the front side 23. The toilet seat 40 has an outer edge 46 and an inner edge 47. The inner edge 47 defines an opening extending through the toilet seat 40. A lid 48 is pivotally attached to the base section 20. The lid 48 is selectively positioned in a horizontal closed position extending over the toilet seat 40 or a vertical open position.

A tubular member 50 is mounted on the bottom side 43 of the toilet seat 40. The tubular member 50 forms a loop having a coupler 51 fluidly coupled thereto. The coupler 51 is positioned adjacent to the rearward end 45 and is aligned with and fluidly coupled to the exhaust inlet 30 when the toilet seat 40 is abutted against the toilet bowl 11. The tubular member 50 has a plurality of apertures 53 extending therein. The apertures 53 are preferably directed inward of the toilet seat 40. The tubular member 50 is positioned generally adjacent to the inner edge 47 of the toilet seat 40.

An actuator 60 is operationally coupled to the air moving assembly 33 for selectively turning the air moving assembly 33 on or off. The actuator 60 preferably includes a pressure sensitive switch 61, a motion detector 62, or a combination of the two. In the case of the pressure sensitive switch 61, it would preferably be attached to the bottom side 43 of the toilet seat 40. The pressure sensitive switch 61 would ideally be adapted to only turn on the air moving assembly 33 when the pressure sensitive switch 61 detects a weight of greater than ten pounds positioned on the toilet seat 40. If the motion detector 62 were to be used, it would be mounted on a bottom side 49 of the toilet lid 48. A timer 63 is operationally coupled to the air moving assembly 33. The timer 63 retains the air moving assembly 33 in an on position for at least one minute, and preferably a maximum of two minutes, after the actuator 60 has been turned to an off position. The on position for the pressure sensitive switch 61 is achieved as long as weight is positioned on the toilet seat 40 and is achieved for the motion detector 62 each instance that the motion detector 62 detects motion. The timer 63 may include a microprocessor or an analog timer.

An air freshening device 70 may be fluidly coupled to the exhaust conduit 30 for adding a selected fragrance to air drawn through the exhaust conduit 30. The air freshening device 70 includes a housing 71 fluidly coupled to the exhaust conduit 30. The housing 71 has a chamber 72 therein for receiving a fragrant fluid. Receptacles 73 are coupled to the chamber 72 for holding a quantity of the fragrant fluid. Fragrant paper wicks 74 may be positioned within the housing 71 for drawing out the fragrance and increasing the surface area from which the fragrance may evaporate. As the air is drawn through the exhaust conduit 30, the fragrance is added to the air. If an exhaust vent 75 is positioned adjacent to the toilet bowl 11, the exhaust conduit 30 may be fluidly coupled to the exhaust vent 75 so that the air drawn through the exhaust conduit 30 is vented outward of the dwelling. In use, the assembly 10 is mounted on a conventional toilet between the toilet bowl 11 and the water tank 12. When the toilet is used, the actuator 60 turns on the air moving assembly 33 so that air within the toilet bowl 11 is vented through the tubular member 50 and outward through the exhaust conduit 30. Fragrance may be added to this vented air or it may be vented outward through an exhaust vent of a dwelling to reduce bathroom odors.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ventilated toilet seat device for positioning between a toilet bowl and a water tank, the water tank including a water outlet, the toilet bowl including a water inlet, said device comprising:

a base section having an upper surface, a bottom surface, a front side, a rear side, a first lateral side and a second lateral side, an aperture extending through said upper and bottom surfaces, said base section being positioned between the toilet bowl and the water tank such that said aperture is aligned with the water outlet and the water inlet, said front side generally facing a bowl portion of the toilet bowl;

an exhaust conduit extending through said base section and including an exhaust inlet and an exhaust outlet, said exhaust inlet being positioned in said front side;

an air moving assembly being mounted in said exhaust conduit for selectively drawing air into said exhaust inlet and forcing the air outwardly through said exhaust outlet;

a toilet seat being hingedly attached to said front side of said base section, said toilet seat having a top side, a bottom side, a forward end and a rearward end, wherein said rearward end is positioned adjacent to said to said front side, said toilet seat having an outer edge and an inner edge, said inner edge defining an opening extending through said toilet seat; and a tubular member being mounted on said bottom side of said toilet seat, said tubular member forming a loop having a coupler fluidly coupled thereto, said coupler being positioned adjacent to said rearward end and being aligned with and fluidly coupled to said exhaust inlet when said toilet seat is abutted against the toilet bowl, said tubular member having a plurality of apertures extending therein.

2. The ventilated toilet seat device of claim 1, wherein said tubular member is positioned generally adjacent to said inner edge of said toilet seat.

3. The ventilated toilet seat device of claim 1, further including an actuator being operationally coupled to said air moving assembly for selectively turning said air moving assembly on or off.

4. The ventilated toilet seat device of claim 3, wherein said actuator includes a pressure sensitive switch attached to said bottom side of said toilet seat.

5. The ventilated toilet seat device of claim 4, further including a timer being operationally coupled to said air moving assembly, said timer retaining said air moving assembly in an on position for at least one minute after said actuator has been turned to an off position.

6. The ventilated toilet seat device of claim 3, further including a lid being pivotally attached to said base section, said lid being selectively positioned in a horizontal closed position extending over said toilet seat or a vertical open position, said actuator comprising a motion detector mounted to a bottom side of said lid, wherein said motion sensor turns on said air moving assembly when said motion detector detects motion.

7. The ventilated toilet seat device of claim 6, further including a timer being operationally coupled to said air moving assembly, said timer retaining said air moving assembly in an on position for at least one minute after said motion detector lasts detects motion.

8. The ventilated toilet seat device of claim 1, further including an air freshening device being fluidly coupled to said exhaust conduit and adopted for adding a selected fragrance to air drawn through said exhaust conduit.

9. A ventilated toilet seat device for positioning between a toilet bowl and a water tank, the water tank including a water outlet, the toilet bowl including a water inlet, said device comprising:

a base section having an upper surface, a bottom surface, a front side, a rear side, a first lateral side and a second lateral side, an aperture extending through said upper and bottom surfaces, said base section being positioned between the toilet bowl and the water tank such that said aperture is aligned with the water outlet and the water inlet, said front side generally facing a bowl portion of the toilet bowl;

an exhaust conduit extending through said base section and including an exhaust inlet and an exhaust outlet, said exhaust inlet being positioned in said front side;

an air moving assembly being mounted in said exhaust conduit for selectively drawing air into said exhaust inlet and forcing the air outwardly through said exhaust outlet;

a toilet seat being hingedly attached to said front side of said base section, said toilet seat having a top side, a bottom side, a forward end and a rearward end, wherein said rearward end is positioned adjacent to said to said front side, said toilet seat having an outer edge and an inner edge, said inner edge defining an opening extending through said toilet seat;

a tubular member being mounted on said bottom side of said toilet seat, said tubular member forming a loop having a coupler fluidly coupled thereto, said coupler being positioned adjacent to said rearward end and being aligned with and fluidly coupled to said exhaust inlet when said toilet seat is abutted against the toilet bowl, said tubular member having a plurality of apertures extending therein, said apertures being directed inward of said toilet seat, said tubular member being positioned generally adjacent to said inner edge of said toilet seat;

an actuator being operationally coupled to said air moving assembly for selectively turning said air moving assembly on or off, said actuator including a pressure sensitive switch attached to said bottom side of said toilet seat;

a timer being operationally coupled to said air moving assembly, said timer retaining said air moving assembly in an on position for at least one minute after said actuator has been turned to an off position;

an air freshening device being fluidly coupled to said exhaust conduit and adopted for adding a selected fragrance to air drawn through said exhaust conduit; and a lid being pivotally attached to said base section, said lid being selectively positioned in a horizontal closed position extending over said toilet seat or a vertical open position.

* * * * *